US009714632B2

(12) United States Patent
Maess et al.

(10) Patent No.: US 9,714,632 B2
(45) Date of Patent: Jul. 25, 2017

(54) METHOD AND DEVICE FOR CONTROLLING A QUANTITY CONTROL VALVE

(71) Applicant: Robert Bosch GmbH, Stuttgart (DE)

(72) Inventors: Matthias Maess, Stuttgart (DE); Joerg Kuempel, Ludwigsburg (DE); Rainer Wilms, Markgroeningen (DE); Uwe Richter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/784,326

(22) PCT Filed: Mar. 12, 2014

(86) PCT No.: PCT/EP2014/054792

§ 371 (c)(1),
(2) Date: Oct. 14, 2015

(87) PCT Pub. No.: WO2014/170068

PCT Pub. Date: Oct. 23, 2014

(65) Prior Publication Data

US 2016/0076501 A1 Mar. 17, 2016

(30) Foreign Application Priority Data

Apr. 15, 2013 (DE) ..... 10 2013 206 674

(51) Int. Cl.
*F02M 59/36* (2006.01)
*F02D 41/20* (2006.01)
(Continued)

(52) U.S. Cl.
CPC ..... *F02M 59/466* (2013.01); *F02D 1/08* (2013.01); *F02D 41/20* (2013.01); *F02D 41/26* (2013.01);
(Continued)

(58) Field of Classification Search
CPC ..... F02D 41/20; F02M 59/36; F02M 59/366; F02M 59/466; F02M 59/20
(Continued)

(56) References Cited

U.S. PATENT DOCUMENTS 5,959,825 A * 9/1999 Harcombe ..... F02D 41/20 361/152
6,701,898 B2 * 3/2004 Tokuo ..... F02D 41/38 123/456
(Continued)

FOREIGN PATENT DOCUMENTS

CN 101312865 A 11/2008
CN 102245881 A 11/2011
(Continued)

OTHER PUBLICATIONS

International Search Report for PCT/EP2014/054792, dated May 27, 2014.

*Primary Examiner* — Mahmoud Gimie
(74) *Attorney, Agent, or Firm* — Norton Rose Fulbright US LLP; Gerard Messina

(57) ABSTRACT

In a fuel system of an internal combustion engine, fuel is delivered by a high-pressure pump into a fuel rail. The quantity of the delivered fuel is influenced by a quantity control valve (30) actuated by an electromagnetic actuating device. A limit-value retaining current is ascertained, at which the quantity control valve still remains in its closed state or is just opening.

19 Claims, 4 Drawing Sheets

(51) Int. Cl.

| | |
|---|---|
| ***F02M 59/46*** | (2006.01) |
| ***F02D 41/38*** | (2006.01) |
| ***F02M 63/02*** | (2006.01) |
| ***F02D 1/08*** | (2006.01) |
| ***F02D 41/26*** | (2006.01) |
| *F02D 1/00* | (2006.01) |

(52) U.S. Cl.
CPC ..... *F02D 41/3845* (2013.01); *F02M 59/36* (2013.01); *F02M 59/367* (2013.01); *F02M 59/368* (2013.01); *F02M 63/0265* (2013.01); *F02D 2001/0085* (2013.01); *F02D 2001/082* (2013.01); *F02D 2041/2055* (2013.01); *F02D 2041/2058* (2013.01); *F02D 2200/0602* (2013.01); *F02D 2700/0282* (2013.01)

(58) Field of Classification Search
USPC .... 123/458, 457, 490, 456, 447; 251/129.15
See application file for complete search history.

(56) References Cited

U.S. PATENT DOCUMENTS

| | | | | |
|---|---|---|---|---|
| 2008/0198529 | A1* | 8/2008 | Rembold | F02D 41/20 361/195 |
| 2010/0237266 | A1* | 9/2010 | Haaf | F02D 41/20 251/129.15 |
| 2011/0315124 | A1* | 12/2011 | Richter | F02D 41/20 123/480 |
| 2012/0167993 | A1* | 7/2012 | Fedor, III | F02D 33/003 137/12 |

FOREIGN PATENT DOCUMENTS

| | | |
|---|---|---|
| DE | 101 48 218 | 4/2003 |
| DE | 10 2008 054702 | 6/2010 |
| DE | 10 2009 046825 | 5/2011 |
| DE | 10 2012 208614 | 11/2013 |
| WO | WO 2010/066663 | 6/2010 |

* cited by examiner

METHOD AND DEVICE FOR CONTROLLING A QUANTITY CONTROL VALVE

BACKGROUND OF THE INVENTION

1. Field of the Invention

The present invention relates to a method and a control device for controlling a quantity control valve of a high-pressure pump.

2. Description of the Related Art

Published German patent application document DE 101 48 218 A1 describes a method for operating a fuel injection system while utilizing a quantity control valve. The known quantity control valve is implemented as a solenoid valve operated electromagnetically by a solenoid coil, having an armature and associated travel-limiting stops. Such quantity control valves, which are closed in the currentless state of the solenoid coil, are known from the market. In this case, for opening the quantity control valve, the solenoid coil is controlled using a constant voltage or a clocked voltage (pulse-width modulation—"PWM"), whereby the current in the solenoid coil rises in characteristic fashion. After the voltage is switched off, the current drops off, in turn, in characteristic fashion, whereby the quantity control valve closes. Solenoid valves, which are open in the energized state of the coil, are also known. In these solenoid valves, there is a corresponding procedure, the solenoid valve opening when the voltage is switched off and the current drops in a characteristic manner.

In the valve that is closed in the currentless state shown in published German patent application document DE 101 48 218 A1, in order to prevent the armature from hitting the stop at full speed during the opening motion of the quantity control valve, which could result in a marked noise development, the electromagnetic actuating device is once more supplied with current, in a pulse-like manner, shortly before then end of the opening motion. A braking force is exerted on the armature by this current pulse, still before it contacts the stop. The braking force reduces the speed, whereby the noise of striking the stop is diminished.

In modern direct injection engine systems having demand-controlled fuel delivery, a high-pressure pump is used for generating the necessary fuel pressure. For this purpose, the high-pressure pump is operated in a quantity-controlled manner, the delivery quantity of the pump being able to be set from 0 to 100% by a quantity control valve. Controlling this quantity control valve is of particular importance since the switching process of the quantity control valve must occur in a very short time and in spite of high magnetic forces due to the high rotational speed and the associated high control frequency, without the lift-to-lift fluctuations and therefore the delivery quantity fluctuations becoming too great. This would result in a lack of rail pressure quality. On the other hand, at low engine speeds, very high demands are made on noise development of the high-pressure pump. For this reason, numerous control concepts have already been developed to reduce the impact dynamics, and thus to reduce the acoustical level. In the process, both the starting motion as well as the decreasing motion of the switching magnet are slowed down.

A control concept for a quantity control valve is described in published German patent application document DE 10 2009 046 825 A1, which is also called a "current soft stop" (CSS). Normally, the quantity control valve is held closed beyond top dead center by the pressure in the delivery chamber of the high-pressure pump. If the delivery chamber pressure drops off, the quantity control valve falls back into the original currentless open position, driven by spring force and non-braked. In the CSS method, the quantity control valve is supplied beyond the upper dead center with a holding current, so that the quantity control valve does not yet drop off immediately. Only after the pressure reduction in the delivery chamber is the current reduced in characteristic fashion, so that the quantity control valve drops off during this low current supply, and falls back into the currentless open position. Because of the counter-induction and the current running through the quantity control valve, the motion is braked in the process, and the impact at the stop takes place substantially less rapidly, and thus more quietly. The holding current should be known as accurately as possible, so that currents for holding and for the onset of motion may be set as precisely as possible. The application of current must be terminated again before the following lower dead center, so that the next delivery process is not disturbed.

It is a problematic fact that, if the current is too low, the CSS method yields only slight acoustical improvements, while currents that are too high cannot effect any improvement, or may even cause an acoustical deterioration and a rail pressure rise. This is due to the fact that, at currents that are too high, the quantity control valve remains closed and does not open.

Since the manufacturing tolerance has to be taken into account in the data input for the current, the effect would be limited under these conditions, since usually the data input is made in such a way that the quantity control valve opens with certainty. That is to say that a current would be selected that is rather too low. In the case of this low current, only a slight improvement is then possibly obtained.

BRIEF SUMMARY OF THE INVENTION

The present invention relates to a quantity control valve, which assumes a closed state when controlled with a first control value, while controlling it with a second control value enables the quantity control valve to assume an open state.

By ascertaining a limit-value holding current, in which the quantity control valve still remains in its closed state or is just opening, a substantially improved control is made possible, in which the acoustical behavior is clearly improved.

Since the properties of the quantity control valve differ from specimen to specimen, an effective reduction in the impact noise is achieved if in the application of current specimen properties such as the limit-value holding current are taken into account.

Because of the control and adaptation according to the present invention, the current level or the application of current, pre-controlled by a PWM signal, to the quantity control valve is adapted to the specimen tolerances in such a way that CSS method for acoustical improvement functions in optimized fashion.

It is particularly advantageous if the limit-value holding current is ascertained on the basis of a fuel pressure signal. Since the fuel pressure signal is evaluated, no further sensors are needed. Furthermore, this signal is available with sufficient accuracy.

A pressure increase may simply be detected by the fact that the application of current to the quantity control valve is extended beyond the lower dead center.

It is of particular advantage, if the control value is increased, beginning from a starting value, at which the quantity control valve remains open, until a rise in the fuel pressure signal occurs so that the limit-value holding current is determined on the basis of the control signal at which the pressure increase occurs. In this case, the operation is only negligibly disturbed, and the driving performance is not impaired.

In an alternative development, the control value is reduced, beginning from a starting value, at which the quantity control valve remains closed, until a drop of the fuel pressure signal occurs so that the limit-value holding current is determined on the basis of the control signal at which the pressure drop occurs.

DETAILED DESCRIPTION OF THE INVENTION

Figure 1:
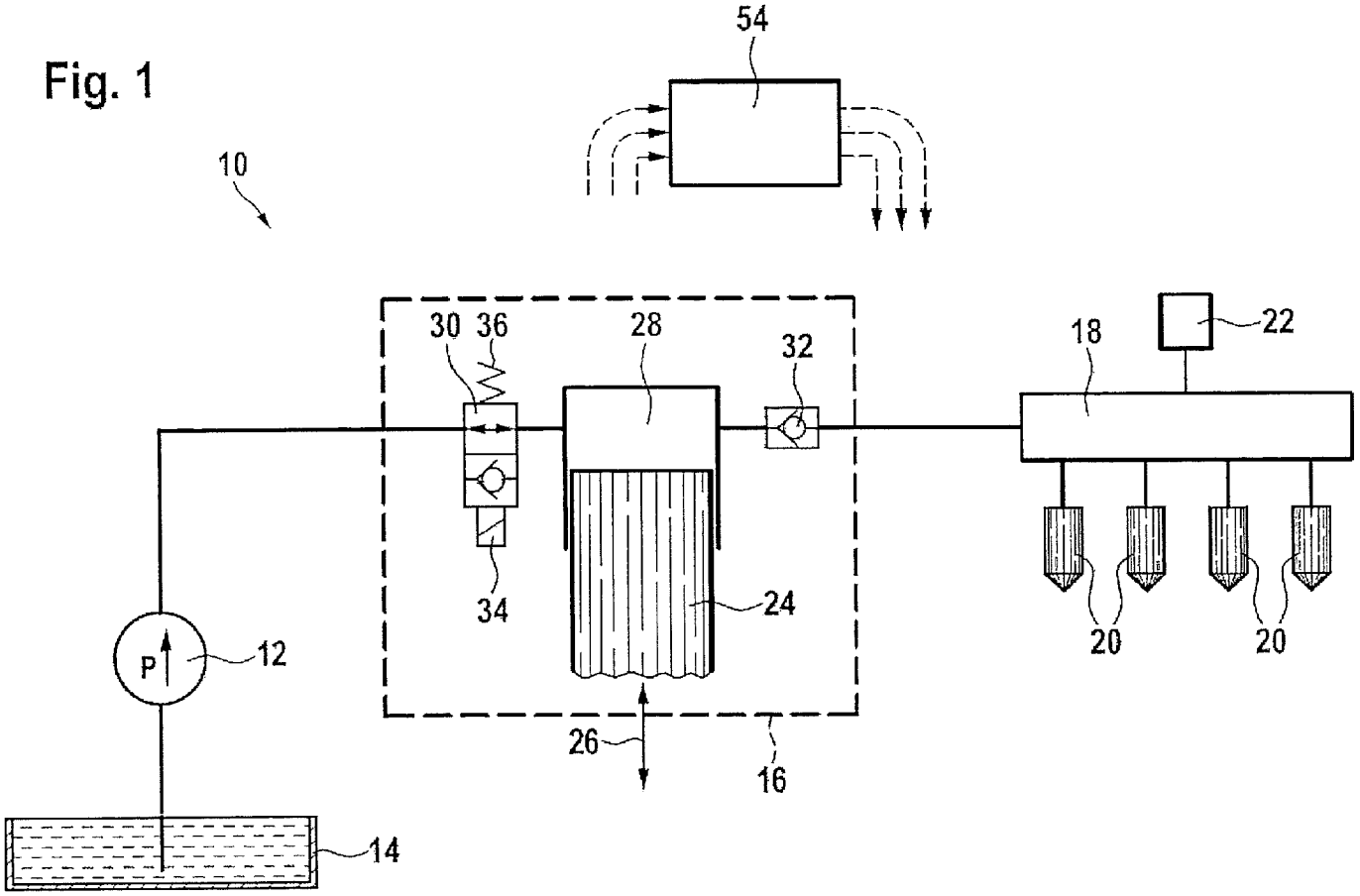
FIG. 1 shows a schematic representation of a fuel injection system of an internal combustion engine having a high-pressure pump and a quantity control valve.

In FIG. 1, a fuel injection system is designated overall by reference numeral 10. It includes an electric fuel pump 12, by which fuel is conveyed from a fuel tank 14 to a high-pressure pump 16. High-pressure pump 16 compresses the fuel to a very high pressure and conveys it on to a fuel rail 18. A plurality of injectors 20 are connected to the latter, which inject the fuel into associated combustion chambers. The pressure in fuel rail 18 is recorded by a pressure sensor 22.

High-pressure pump 16 is a piston pump having a delivery plunger 24, which is able to be put into a back-and-forth motion (double arrow 26) by a camshaft that is not shown. Delivery plunger 24 delimits a delivery chamber 28, which is able to be connected via a quantity control valve 30 to the outlet of electric fuel pump 12. Delivery chamber 28 may further be connected to fuel rail 18 via an outlet valve 32.

Quantity control valve 30 includes an electromagnetic actuating device 34, for example, which works counter to the force of a spring 36 when it has current applied to it. In the form of the exemplary embodiment, quantity control valve 30 is open in the currentless state, but when it has current applied to it, it has the function of a normal inlet check valve.

Figure 2:
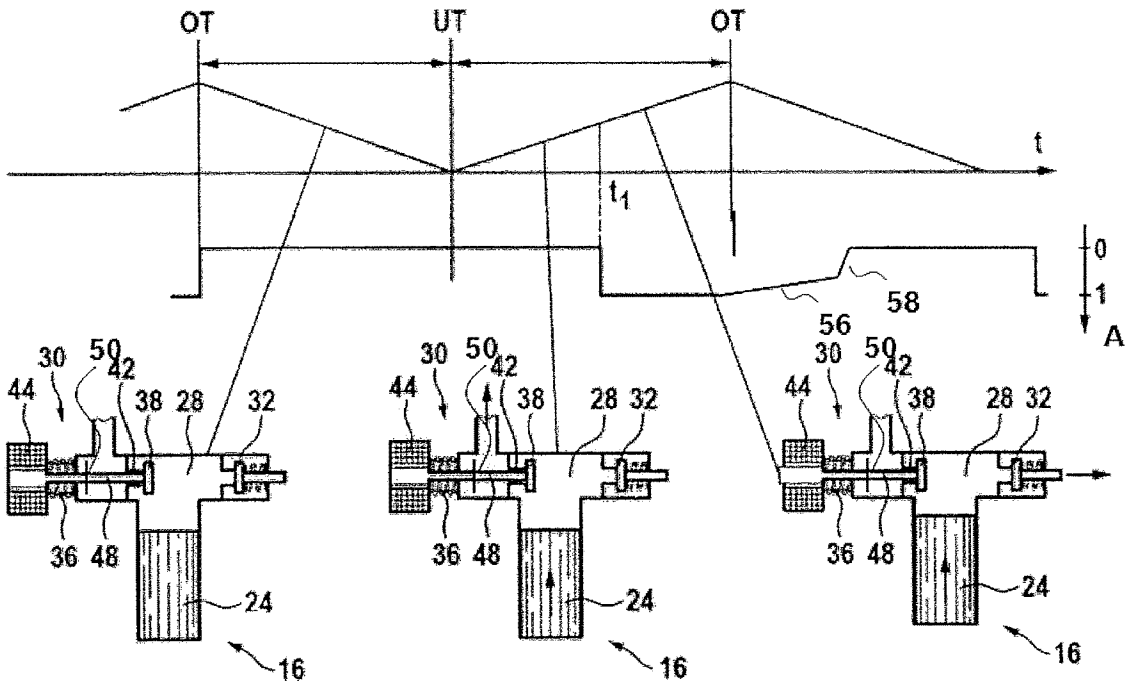
FIG. 2 shows a schematic representation of the interrelationship between the control signal and the state of the quantity control valve.

High-pressure pump 16 and quantity control valve 30 operate as follows (see FIG. 2):

At the top in FIG. 2, a lift of piston 34 and below it a control signal are plotted over time. The control signal is designated by reference symbol "A". The value of the control signal lies between a first control value, which is designated in FIG. 2 by "0", and a second control value, which is designated in FIG. 2 by "1". The first control value corresponds, for example, to the non-energized state of the electromagnetic actuating device 34, and the second value to the energized state. The following is based on this exemplary embodiment.

In addition, high-pressure pump 16 is shown schematically in various operating states. During an intake lift (left illustration in FIG. 2), solenoid coil 44 is currentless, whereby actuating pushrod 48 is pressed by spring 36 against valve element 38, and moves the latter into its open position. In this way, fuel is able to flow from electric fuel pump 12 into delivery chamber 28. After lower dead center UT is reached, the delivering lift of delivery plunger 24 begins. This is shown in FIG. 2, in the middle. Solenoid coil 44 continues to be currentless, whereby quantity control valve 30 is forced to remain open. The fuel is ejected by delivery plunger 24 to electric fuel pump 12 via open quantity control valve 30. Outlet valve 32 remains closed. A delivery into fuel rail 18 does not take place. At a time t1, current is applied to solenoid coil 44, whereby actuating pushrod 48 is pulled away from valve element 38. At this point it should be pointed out that in FIG. 2, the curve of the energization of solenoid coil 44 is shown only schematically. It should be noted that the actual coil current is not constant, but, due on counter-induction effects, possibly tracks the curve of typical transient effects. In addition, in the case of a pulse-width modulated control voltage, the coil current is wave-shaped or has a pointed shape.

The fuel quantity delivered by high-pressure pump 16 to fuel rail 18 is influenced by a variation of time t1. Time t1 is established by a control and regulation device 54 (FIG. 1) in such a way that an actual pressure in fuel rail 18 corresponds as closely as possible to a setpoint pressure. For this purpose, signals supplied by pressure sensor 22 are processed in control and regulation device 54.

Due to the pressure in delivery chamber 28, valve element 38 lies against valve seat 42, that is, quantity control valve 30 is closed. A pressure is now able to build up in delivery chamber 28, which results in the opening of outlet valve 32 and in a delivery into fuel rail 18. This is illustrated in FIG. 2 on the right. Shortly after reaching upper dead center OT of delivery plunger 24, the energization of solenoid coil 44 is ended, whereby quantity control valve 30 returns to its compulsorily opened position again.

When the energization of solenoid coil 44 is terminated, actuating pushrod 48 is moved against a first stop 50. In order to reduce the impact speed at first stop 50, an intermittently dropping signal curve 56 is generated, by which the speed of motion of actuating pushrod 48 is reduced before hitting first stop 50. During a second dropping signal curve 58, the control signal is brought to the first control value. This second dropping signal curve 58 may, for instance, be given by a rapid extinction of the coil current of electromagnetic actuating device 34.

Figure 3:
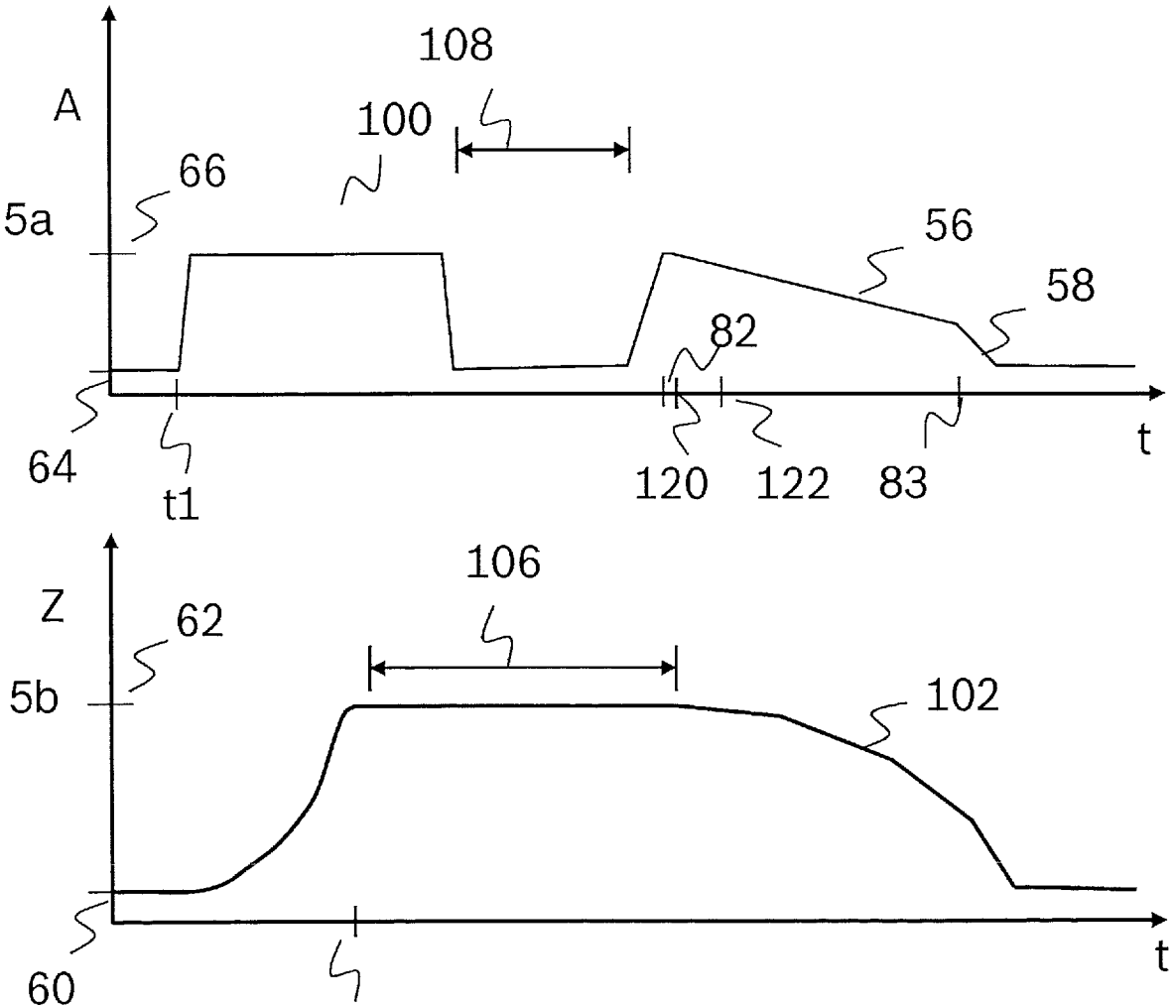
FIG. 3 shows a second schematic representation of the curve over time of the control signal and the curve over time of the state of the quantity control valve.

FIG. 3 shows a curve over time 100, selected in exemplary fashion, of the control signal designated by "A" and curve over time 102 of the state of quantity control valve 30 designated by "Z". At time t1, the value of the control signal is increased from second control value 64 to first control value 66. As a result, quantity control valve 30 transitions from opened state 60 to closed state 62, and closes at time 104. During a retaining phase 106, quantity valve 30 remains closed. Due to the pressure in delivery chamber 28, which retains quantity control valve 30 in the closed state, during a time period 108, the control signal is able to assume second control value 64, that is, it may be non-energized, for example. In a further variant of the method, the retaining current may also be held further during time period 108 by applying the first control value. Before reaching upper dead center 120 of delivery plunger 24 or before the opening 122 of outlet valve 32, the value of the control signal is raised again to first control value 66. A new control action is performed starting at time 82. In order for the noise emissions to be clearly reduced, according to the present invention, the value of the control signal, at the time at which the pressure in delivery chamber 28 has dropped so far that it no longer retains quantity control valve 30 in closed state 62, is specified on the basis a limit-value retaining current.

The limit-value retaining current is that retaining current at which the quantity control valve remains in its closed state in response to a previous application of current. If a higher current is selected than the limit-value retaining current, the quantity control valve remains closed. If a lower current is selected, the quantity control valve opens.

In order to detect whether the current that was just output lies above or below the limit-value retaining current, the current is prolonged beyond the lower dead center of the high-pressure pump. If the quantity control valve is still pulled up, because the current is above the limit-value retaining current, a full delivery of the high-pressure pump ensues. This full delivery may easily be detected by the pressure increase in the rail, using the rail pressure sensor. If the limit-value retaining current is undershot, no delivery ensues and no pressure increase.

In the method according to the present invention, starting from a current level at which the quantity control valve opens with certainty, the prolonged current continues to be increased successively from delivery to delivery until a pressure increase is detected. The limit-value retaining current associated with the currently present quantity control valve specimen is thereby detected under the respective boundary conditions.

Alternatively, it may also be provided that, starting from a current level at which the quantity control valve remains closed, the prolonged current be continually further reduced successively from delivery to delivery until a pressure drop is detected.

Figure 4:
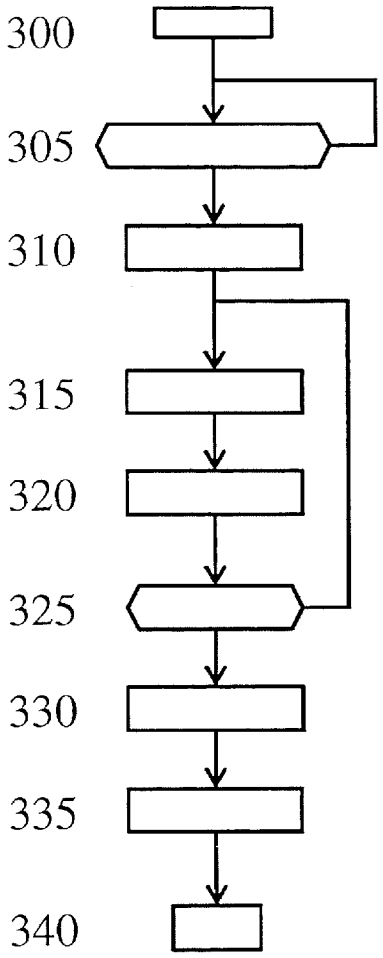
FIG. 4 a flow chart for illustrating the procedure according to the present invention.

One specific embodiment of the procedure, according to the present invention, is described in exemplary fashion with reference to FIG. 4.

The adaptation method starts in a first step 300. The subsequent query 305 checks whether the switch-on conditions for the adaptation are satisfied.

The switch-on conditions are to ensure boundary conditions that are as uniform as possible for the adaptation process. For this reason, the adaptation is performed only in a certain rotational speed range, vehicle speed range, battery voltage range, rail pressure range, load range, temperature range, preferably when the engine is idling, but also during uniform slow travel. The setpoint pressure specification of the rail pressure also must not change.

In subsequent step 310, a starting value is set for the retaining current. Furthermore, the application of current is prolonged beyond lower dead center of the high-pressure pump. This ensures that the quantity control valve, when energized accordingly, remains closed until the next delivery lift, which begins after the lower dead center. If the quantity control valve is energized with a current value above the limit-value retaining current, it remains closed in this case, and no pressure buildup occurs. If the quantity control valve is energized with a current value below the limit-value retaining current, the quantity control valve is able to open when the pressure has dropped off. The starting value is preferably specified in such a way that the quantity control valve opens when the pressure has dropped off.

In step 315, the current value is incremented by a specific value. In subsequent step 320, the rail pressure is detected in the high-pressure region downstream from the high-pressure pump.

Subsequent query 325 checks whether the rail pressure has risen. For this purpose, it is checked, for example, whether the gradient of the rail pressure is greater than a threshold value. Or a check is performed to determine whether, since the last detection, the rail pressure has risen by more than a threshold value.

If this is not the case, that is, no pressure increase occurs, then, in step 315, the current value is incremented by a certain value. If a rail pressure increase is detected in step 325, then this is followed by step 330.

In step 330 the adaptation is terminated. The instantaneous current value or the current value prior the last incrementation is used as the limit-value retaining current. Alternatively, it is also possible to use a value calculated from the two values, particularly the average value of these two values, as the limit-value retaining current.

In step 335, the parameters for the CSS energization are ascertained on the basis of the limit-value retaining current. Furthermore, the duration of the application of current is set back to the normal value.

The method ends in subsequent step 340.

This limit-value retaining current is then used for the correct CSS control, in that the application of current of the CSS method is calculated or corrected as a function of this detected limit-value retaining current.

The retaining current before the CSS phase, which corresponds to the time period prior to the drop of the delivery chamber pressure, is selected with a suitable increase with respect to the ascertained limit-value retaining current, so that the quantity control valve is reliably kept closed. The current value for the desired drop into the open position of the quantity control valve is selected, for example, to be a current that is reduced by a suitable amount compared to the ascertained limit-value retaining current. This is to ensure, on the one hand, that the quantity control valve is retained reliably until the beginning of motion is to be initiated, and, on the other hand, to achieve the maximum braking effect of the current during the motion of the quantity control valve. In this phase, the current is selected to be barely below the retaining current required for the specimen.

The characterization of the respective quantity control valve specimen obtained by the adaptation method may be used not only for an improvement of the CSS method. An additional use would be, within the scope of normal control, the determination of the limit-value retaining current for reducing the effective current level as well as the power loss.

What is claimed is:

1. A method for controlling a quantity control valve of a high-pressure pump, comprising:

controlling, using a first selected value of a control signal, the quantity control valve to assume a closed state;

controlling, using a second selected value of the control signal, the quantity control valve to assume an open state; and ascertaining a limit-value retaining current at which the quantity control valve is retained in the closed state, the limit-value retaining current being a current above which the quantity control valve remains closed and below which the quantity control valve opens.

2. The method as recited in claim 1, wherein the limit-value retaining current is ascertained on the basis of a fuel pressure signal and is ascertained over a plurality of successive pump deliveries of the high-pressure pump.

3. The method as recited in claim 2, wherein the application of current to the quantity control valve is prolonged beyond a lower dead center of the high-pressure pump.

4. The method as recited in claim 2, further comprising:

increasing successively over the plurality of successive pump deliveries a value of the control signal from a starting value at which the quantity control valve remains open, until a rise in a pressure as indicated by the fuel pressure signal is detected;

wherein the limit-value retaining current is ascertained based on a value of the control signal at which the pressure increase occurs.

5. The method as recited in claim 2, further comprising:

decreasing successively over the plurality of successive pump deliveries a value of the control signal from a starting value at which the quantity control valve remains closed, until a drop in a pressure as indicated by the fuel pressure signal is detected;

wherein the limit-value retaining current is ascertained based on a value of the control signal at which the pressure drop occurs.

6. The method as recited in claim 2, wherein the value of the control signal is applied to the quantity control valve after a upper dead center of an actuating device of the quantity control valve is specified on the basis of the limit-value retaining current.

7. The method as recited in claim 1, further comprising:

controlling a closing operation of the quantity control valve based on the limit-value retaining current.

8. The method as recited in claim 4, wherein the rise in the fuel pressure signal is determined by comparing a gradient of the fuel pressure signal with a threshold value.

9. The method as recited in claim 5, wherein the drop in the fuel pressure signal is determined by comparing a gradient of the fuel pressure signal with a threshold value.

10. A non-transitory computer-readable data storage medium storing a computer program having program codes which, when executed by a computer, perform a method for controlling a quantity control valve of a high-pressure pump of a fuel injection system, the method comprising:

controlling, using a first selected value of a control signal, the quantity control valve to assume a closed state;

controlling, using a second selected value of the control signal, the quantity control valve to assume an opened state; and ascertaining a limit-value retaining current at which the quantity control valve is retained in the closed state, the limit-value retaining current being a current above which the quantity control valve remains closed and below which the quantity control valve opens.

11. The non-transitory computer-readable storage medium as recited in claim 10, wherein the limit-value retaining current is ascertained on the basis of a fuel pressure signal and is ascertained over a plurality of successive pump deliveries of the high-pressure pump.

12. The non-transitory computer-readable storage medium as recited in claim 11, where the method further comprises:

increasing successively over the plurality of successive pump deliveries a value of the control signal from a starting value at which the quantity control valve remains open, until a rise in a pressure as indicated by the fuel pressure signal is detected;

wherein the limit-value retaining current is ascertained based on a value of the control signal at which the pressure increase occurs.

13. The non-transitory computer-readable storage medium as recited in claim 11, where the method further comprises:

decreasing successively over the plurality of successive pump deliveries a value of the control signal from a starting value at which the quantity control valve remains closed, until a drop in a pressure as indicated by the fuel pressure signal is detected;

wherein the limit-value retaining current is ascertained based on a value of the control signal at which the pressure drop occurs.

14. The non-transitory computer-readable storage medium as recited in claim 10, wherein the method further comprises:

controlling a closing operation of the quantity control valve based on the limit-value retaining current.

15. A device for controlling a quantity control valve of a high-pressure pump of a fuel injection system, comprising:

a control unit including a processor configured to perform the following:

control, using a first selected value of a control signal, the quantity control valve to assume a closed state;

control, using a second selected value of the control signal, the quantity control valve to assume an opened state; and ascertain a limit-value retaining current at which the quantity control valve is retained in the closed state, the limit-value retaining current being a current above which the quantity control valve remains closed and below which the quantity control valve opens.

16. The device as recited in claim 15, wherein the limit-value retaining current is ascertained on the basis of a fuel pressure signal and is ascertained over a plurality of successive pump deliveries of the high-pressure pump.

17. The device as recited in claim 16, wherein the control unit is further configured to:

increase successively over the plurality of successive pump deliveries a value of the control signal from a starting value at which the quantity control valve remains open, until a rise in a pressure as indicated by the fuel pressure signal is detected; and wherein the limit-value retaining current is ascertained based on a value of the control signal at which the pressure increase occurs.

18. The device as recited in claim 16, wherein the control unit if further configured to:

decrease successively over the plurality of successive pump deliveries a value of the control signal from a starting value at which the quantity control valve remains closed, until a drop in a pressure as indicated by the fuel pressure signal is detected; and wherein the limit-value retaining current is ascertained based on a value of the control signal at which the pressure drop occurs.

19. The device as recited in claim 15, wherein the control unit is further configured to:

control a closing operation of the quantity control valve based on the limit-value retaining current.

* * * * *